US006425963B1

(12) United States Patent
Kaneko et al.

(10) Patent No.: US 6,425,963 B1
(45) Date of Patent: Jul. 30, 2002

(54) HIGH TENSILE STRENGTH HOT-ROLLED STEEL SHEET

(75) Inventors: Shinjiro Kaneko; Tetsuo Shimizu; Osamu Furukimi, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/490,267

(22) Filed: Jan. 24, 2000

(30) Foreign Application Priority Data

Feb. 9, 1999 (JP) ..... 11-031353

(51) Int. Cl.[7] ..... C22C 38/00
(52) U.S. Cl. ..... 148/320; 420/128
(58) Field of Search ..... 420/8, 87, 104, 420/117, 120, 128; 148/559, 579, 648, 654, 320

(56) References Cited

U.S. PATENT DOCUMENTS 4,008,078 A * 2/1977 Flugge et al. ..... 420/120
4,790,889 A * 12/1988 Maid et al. ..... 148/333
5,304,259 A * 4/1994 Miyakusu et al. ..... 148/325

FOREIGN PATENT DOCUMENTS

JP 60145355 * 7/1985 ..... 420/87
JP 10-183301 A * 7/1998

OTHER PUBLICATIONS

Machine English Translation of JP 10–183301 A, obtained from JPO website, URL: http://www1.ipdl.jpo.go.jp/PA1/cgi–bin/PA1INDEX.*

* cited by examiner

*Primary Examiner*—Roy King
*Assistant Examiner*—Harry D. Wilkins, III
(74) *Attorney, Agent, or Firm*—Schnader Harrison Segal & Lewis LLP

(57) ABSTRACT

High tensile strength hot-rolled steel sheet suitable for use in interior materials for automobiles and a method for producing the same, in which bake hardenability, fatigue resistance, crash resistance, and resistance to room temperature aging are improved, containing 0.01% to 0.12% by weight of carbon, 2.0% by weight or less of silicon, 0.01% to 3.0% by weight of manganese, 0.2% by weight or less of phosphorus, 0.001% to 0.1% by weight of aluminum, and 0.003% to 0.02% by weight of nitrogen and subjected to hot rolling and cooling at a cooling rate of 50° C./s or more within 0.5 second after hot rolling; the hot-rolled steel sheet has a structure including a ferrite having an average grain diameter of 8 $\mu$m or less as a primary phase, the amount of solute Nitrogen ranges from 0.003% to 0.01%, and the ratio, Ngb/Ng, of an average concentration Ngb of nitrogen dissolved in the ferrite grain boundary to an average concentration Ng of nitrogen dissolved in ferrite grains ranges from 100 to 10,000.

5 Claims, 4 Drawing Sheets

| | FERRITE GRAIN DIAMETER (μm) | SOLUTE N (ppm) | Ngb / Ng |
|---|---|---|---|
| ● | 6.2 | 67 | 126 |
| ○ | 9.6 | 12 | 87 |

HIGH TENSILE STRENGTH HOT-ROLLED STEEL SHEET

BACKGROUND OF THE INVENTION

1. Field of the Invention

The present invention relates to hot-rolled steel sheet suitable for use in structural components, suspension components, etc. for automobiles, and more particularly to hot-rolled steel sheet having improved bake hardenability and fatigue resistance, crash resistance, and resistance to room temperature aging. The expression "improvement in bake hardenability" refers to increase in yield strength as well as in tensile strength after forming and paint baking.

2. Description of the Related Art

For automobiles increase in strength per unit weight has been required in order to increase gas mileage by reducing weight. However, the increase in strength of steel sheet makes it difficult to perform press forming. For passenger safety, improvement in crash resistance, that is evaluated by the amount of absorbed energy at high strain rates, such as at a time of collision, has also been desired.

In order to increase strength while preventing deterioration in press formability, techniques utilizing so-called "bake hardenability" (hereinafter referred to as "BH") have been known, in which the strength is relatively low during forming so that working is easily performed and the strength is increased by paint baking, for example, as disclosed in Japanese Unexamined Patent Publication Nos. 6-73498 and 7-268544. The techniques have been widely used for cold-rolled steel sheets. However, with respect to the improvement in bake hardenability obtained by the above techniques, only yield strength is increased and tensile strength is not increased. Thus, although the dent resistance in outer panel for automobiles is effectively improved, the fatigue resistance and crash resistance required for inter panels are not improved.

On the other hand, Japanese Unexamined Patent Publication No. 1-180917 discloses a method for producing a hot-rolled steel sheet having excellent workability and bake hardenability, in which a steel containing 0.030% to 0.100% by weight of C, 0.0015% to 0.0150% by weight of N, and 0.025% to 0.100% by weight of Al is heated to 1,200° C. or less, finish-rolling is performed at temperatures from ($Ar_3$+30° C.) to 950° C., and quenching is performed at a cooling rate of 30° C./s or more to 500° C. or less within 3 seconds after rolling, followed by coiling at 400 to 500° C. In the technique disclosed in Japanese Unexamined Patent Publication No. 1-180917, quenching is performed after rolling so that the amount of C and N dissolved in the steel sheet is increased, thus improving the BH.

Japanese Unexamined Patent Publication No. 4-74824 discloses a method for producing a hot-rolled steel sheet having excellent bake hardenability and workability, in which a steel containing 0.02% to 0.13% by weight of C, 0.0080% to 0.0250% by weight of N, and 0.10% or less of sol. Al is re-heated to 1,100° C. or more, hot rolling that finishes at temperatures of 850 to 950° C. is performed, and cooling is performed to 350° C. or less at a cooling rate of 15° C./second or more, with or without air cooling being included, followed by coiling.

Japanese Unexamined Patent Publication No. 63-96248 discloses a bake hardenable hot-rolled steel sheet, in which a steel containing 0.010% to 0.025% by weight of C, 0.0015% to 0.0030% by weight of N, 0.01% to 0.05% of Nb, and 0.008% or less of sol. Al, is used, and appropriate amounts of solute C and solute N remain by controlling the coiling temperature after hot rolling. According to the disclosure, the fatigue limit increases after forming and paint baking.

Japanese Unexamined Patent Publication No. 10-183301 discloses a technique with respect to a steel containing 0.01% to 0.12% by weight of C and 0.0001% to 0.01% by weight of N, in which the BH (increase in yield strength by baking treatment) is improved by controlling the cooling rate after hot rolling and the coiling temperature.

However, with respect to hot-rolled steel sheets produced using the technique disclosed in Japanese Unexamined Patent Publication No. 1-180917, the resistance to room temperature aging is deteriorated, which is disadvantageous. Additionally, although yield strength after paint baking is increased, an increase in tensile strength is not achieved at the same time, and thus significant improvements in fatigue resistance and crash resistance are not expected.

Hot-rolled steel sheets produced using the technique disclosed in Japanese Unexamined Patent Publication No. 4-74824 have a multi-phase structure mainly composed of ferrite and martensite, and although tensile strength after forming and paint baking is increased, an improvement in resistance to room temperature aging is not taken into consideration, and the resistance to room temperature aging is deteriorated, which is disadvantageous.

With respect to steel sheets disclosed in Japanese Unexamined Patent Publication No. 63-96248, in comparison with an increase in yield strength, the fatigue limit is not greatly increased, to approximately 25 MPa at most, and fatigue resistance is not substantially increased.

With respect to hot-rolled steel sheets produced using the technique disclosed in Japanese Unexamined Patent Publication No. 10-183301, although yield strength after forming and paint baking is increased, an increase in tensile strength is not achieved. Therefore, fatigue resistance and crash resistance are not substantially improved.

SUMMARY OF THE INVENTION

It is an object of the present invention to overcome the disadvantages associated with the conventional techniques described above. Specifically, it is an object of the present invention to provide a high tensile strength hot-rolled steel sheet having a tensile strength exceeding about 370 MPa suitable for use in interior materials for automobiles and a method for producing the same, in which bake hardenability, fatigue resistance, crash resistance, and resistance to room temperature aging are improved without excessive addition of dissolved elements.

In one aspect, a high tensile strength hot-rolled steel sheet having excellent bake hardenability, fatigue resistance, crash resistance, and resistance to room temperature aging, in accordance with the present invention, contains about 0.01% to 0.12% by weight of C, 2.0% by weight or less of Si, 0.01% to 3.0% by weight of Mn, 0.2% by weight or less of P, 0.001% to 0.1% by weight of Al, 0.003% to 0.02% by weight of N, and the balance being Fe and incidental impurities. The hot-rolled steel sheet has a structure including a ferrite having an average grain diameter of about 8 $\mu$m or less, or preferably about 6 $\mu$M or less, as a primary phase, and further contains about 0.003% to 0.01% by weight, or preferably about 0.005% to 0.01% by weight of solute N. The ratio of an average concentration Ngb of solute N within a range of ±5 nm from the ferrite grain boundary to an average concentration Ng of solute N in grains, namely, Ngb/Ng, ranges from about 100 to 10,000.

The high tensile strength hot-rolled steel sheet having excellent bake hardenability, fatigue resistance, crash resistance, and resistance to room temperature aging may further contain at least one of about 0.001% to 0.1% by weight of Ti and about 0.001% to 0.1% by weight of Nb and/or at least one element selected from the group consisting of about 0.1% to 1.5% by weight of Ni, about 0.1% to 1.5% by weight of Cr, and about 0.1% to 1.5% by weight of Mo.

In the high tensile strength hot-rolled steel sheet having excellent bake hardenability, fatigue resistance, crash resistance, and resistance to room temperature aging, the structure may be selected from the group consisting of pearlite, bainite, martensite, and retained austenite, or combinations, as a secondary phase.

In the high tensile strength hot-rolled steel sheet having excellent bake hardenability, fatigue resistance, crash resistance, and resistance to room temperature aging, a plated layer may be formed on the surface thereof.

In another aspect, a method for producing a high tensile strength hot-rolled steel sheet having excellent bake hardenability, fatigue resistance, crash resistance, and resistance to room temperature aging, in accordance with the present invention, includes the steps of heating a steel material containing about 0.01% to 0.12% by weight of C, about 2.0% by weight or less of Si, about 0.01% to 3.0% by weight of Mn, about 0.2% by weight or less of P, about 0.001% to 0.1% by weight of Al, and about 0.003% to 0.02% by weight of N in a temperature range from about 1,000 to 1,300° C., and preferably from about 1,070 to 1,180° C.; rough-rolling the steel material; finish-rolling the rough-rolled steel material with a reduction at a final stand of about 10% or more at a finishing temperature FDT of ($Ar_3$+about 100° C.) to ($Ar_3$+about 10° C.); cooling at a cooling rate of about 50° C./s or more within 0.5 second after the finish-rolling; and coiling at a coiling temperature of about 600 to 350° C.

In the method for producing a high tensile strength hot-rolled steel sheet having excellent bake hardenability, fatigue resistance, crash resistance, and resistance to room temperature aging, the steel material may further contain at least one of about 0.001% to 0.1% by weight of Ti and about 0.001% to 0.1% by weight of Nb and/or at least one element selected from the group consisting of about 0.1% to 1.5% by weight of Ni, about 0.1% to 1.5% by weight of Cr, and about 0.1% to 1.5% by weight of Mo.

DESCRIPTION OF THE PREFERRED EMBODIMENTS

Figure 1:
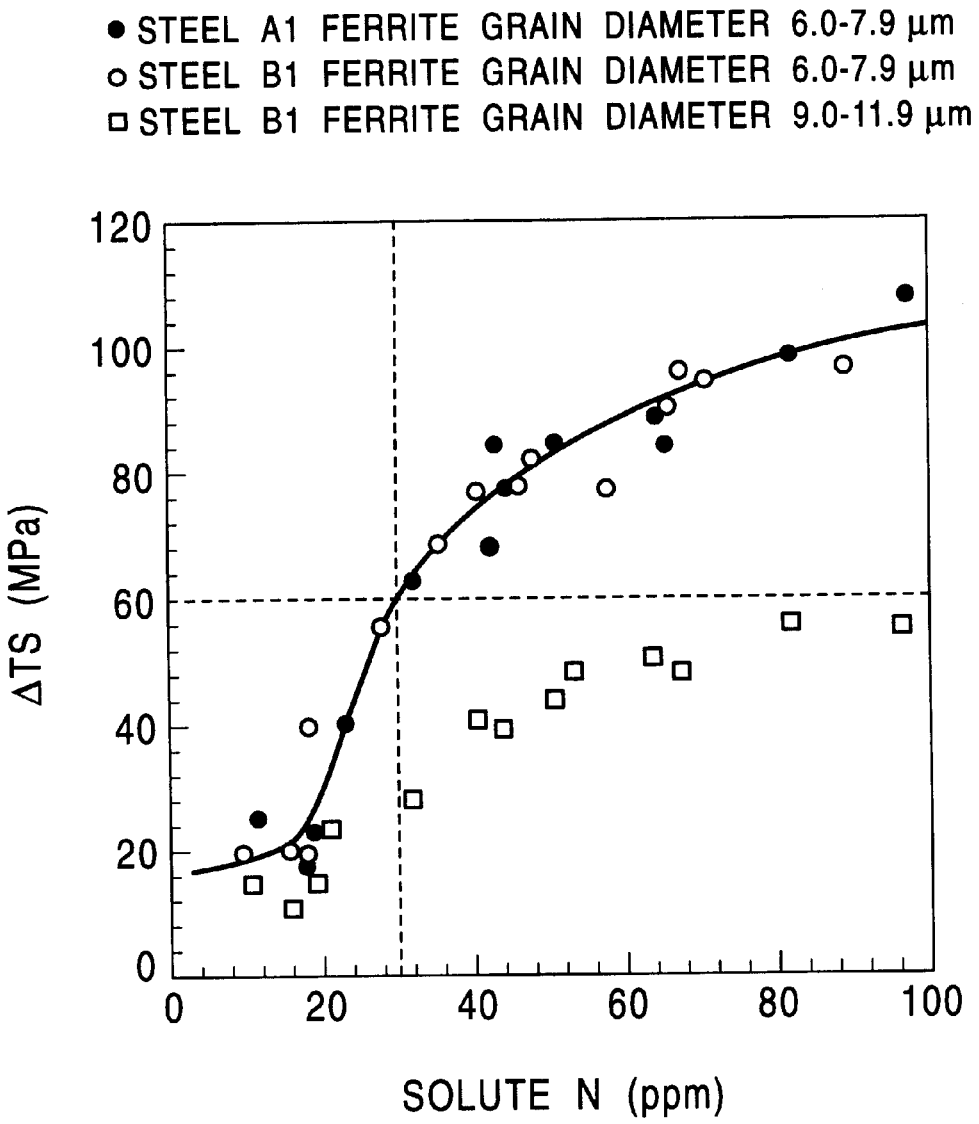
FIG. 1 is a graph showing a relationship between solute N and ΔTS, namely, a difference between tensile strength after forming and paint baking and tensile strength as hot-rolled.

We have discovered surprisingly that, in order to obtain a hot-rolled steel sheet having excellent resistance to room temperature aging in which tensile strength increases after forming and paint baking, it is effective to control the state of solute N that is dissolved in the steel sheet so that the amount of solute N existing in the grain boundary in the steel is adjusted in a particular range. It has been found that, upon refining the grains to increase the gain boundary, by revising the amount of solute N in the steel sheet to predetermined amounts and further adjusting the ratio of (a) the amount Ngb of solute N in the grain boundary to (b) the amount Ng of solute N in grains to a particular range, the deterioration of resistance to room temperature aging is prevented, the tensile strength after forming and paint baking is significantly increased, and the fatigue resistance and crash resistance are improved.

Relevant experimental results will now be specifically described.

By using a steel Al containing 0.065% by weight of C, 0.005% by weight of Si, 0.49% by weight of Mn, 0.01% by weight of P, 0.021% by weight of Al, and 0.015% by weight of N, and a steel B1 containing 0.07% by weight of C, 0.12% by weight of Si, 1.2% by weight of Mn, 0.02% by weight of P, 0.015% by weight of Al, and 0.015% by weight of N, we produced various types of hot-rolled steel sheets by adjusting the production conditions such as hot rolling conditions and by changing amounts of solute N and ferrite grain diameters. In experiment 1, with respect to the steel Al, the amount of solute N was changed in a range from 5 to 100 ppm and the ferrite grain diameter was changed in a range from 6.0 to 7.9 μm. With respect to the steel 1, the amount of solute N was changed in a range from 5 to 100 ppm and the ferrite grain diameter was changed in ranges from 6.0 to 7.9 μm and from 9.0 to 11.9 μm. Amounts of solute N in ferrite grain boundaries and in grains (hereinafter referred to as Ngb and Ng, respectively) in the above hot-rolled steel sheets were measured using a three-dimensional atom probe. The measurement was conducted at a temperature of 50 K with applied voltages of 7 to 15 kV and pulse ratios of 15% to 20%. As a result, in all the hot-rolled steel sheets used, the ratio Ngb/Ng ranged from 100 to 10,000. The amount of solute N (Ngb) in the grain boundary measured using the three-dimensional atom probe refers to an average concentration of solute N within a range of ±5 nm from the grain boundary.

Test specimens as per Japanese Industrial Standard (JIS) No. 5 were gathered from the hot-rolled steel sheets. Firstly, an ordinary tensile test was conducted. Secondly, a tensile test was conducted, in which a prestrain in tension of 8% was imposed and then removed, heat treatment at 170° C. for 20 minutes (corresponding to paint baking) was conducted, and a tensile strain was imposed again. Then, ΔTS, namely, the difference between the tensile strength $TS_{BH}$ after forming and paint baking and the tensile strength TS obtained by the ordinary tensile test for hot-rolled sheets, was obtained.

FIG. 1 of the drawings shows relationships between ΔTS and amounts of solute N.

As is shown by FIG. 1, by setting the ferrite grain diameter in the range from 6.0 to 7.9 μm and the amount of solute N at 30 ppm or more, ΔTS becomes about 60 MPa or more, and thus bake hardenability is significantly improved. In contrast, when the ferrite grain diameter is set in the range from about 9.0 to 11.9 μm, (square marks in FIG. 1) ΔTS is not substantially increased, and does not go up to 60 MPa or more, even if the amount of solute N is increased even to as high as 100 ppm.

Next, in experiment 2, using the steel B1, the amount of solute N was changed in a range from about 30 to 80 ppm and the ferrite grain diameter was changed in a range from about 3.0 to 15.0 μm.

Figure 2:
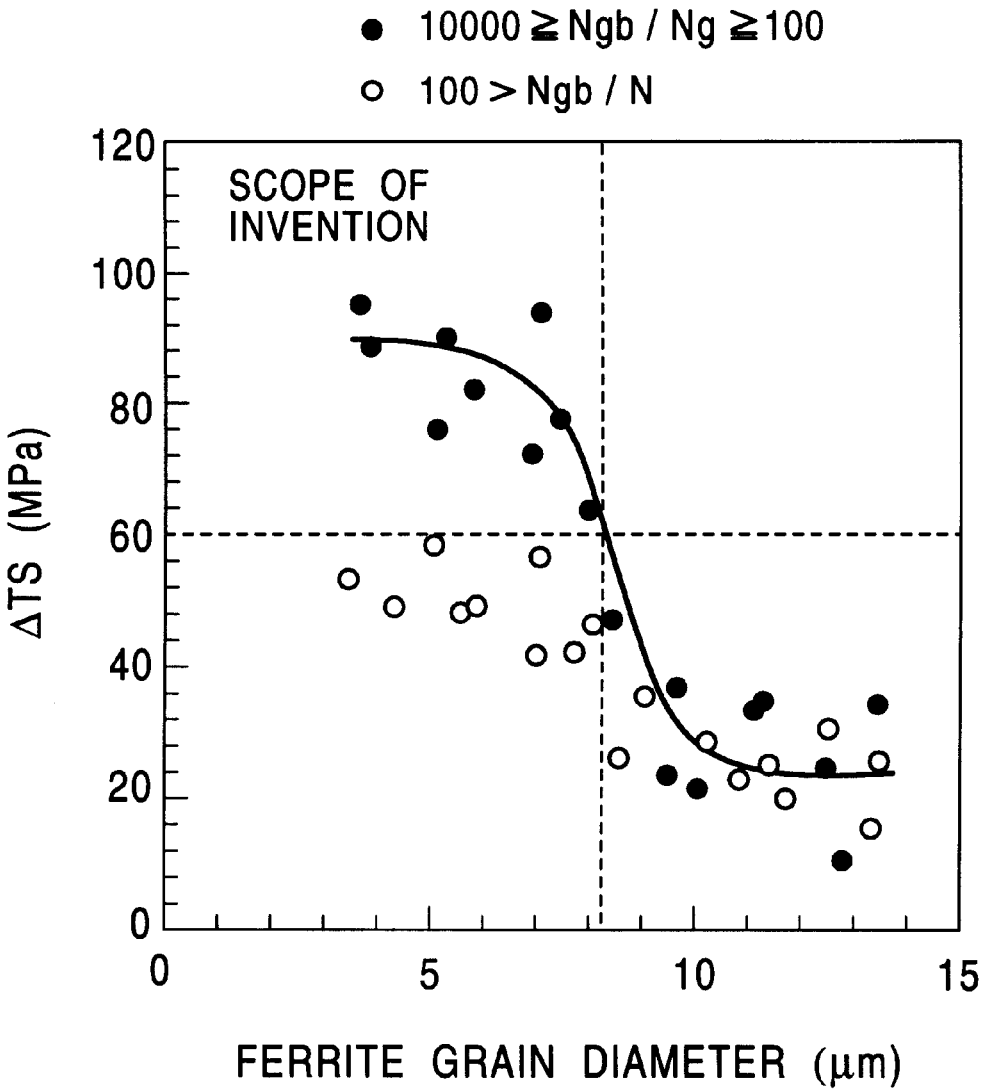
FIG. 2 is a graph showing a relationship between ferrite grain diameters and ΔTS, namely, a difference between tensile strength after forming and paint baking and tensile strength as hot-rolled.

With respect to these hot-rolled steel sheets, in a manner similar to that in experiment 1, amounts of solute N in ferrite grain boundaries and in grains, namely, Ngb and Ng, were measured. ΔTS, namely, the difference between the tensile strength $TS_{BH}$ after forming and paint baking and the tensile strength TS obtained by the ordinary tensile test for hot-rolled sheets, was also obtained in a manner similar to that in experiment 1. FIG. 2 shows the relationship obtained between ΔTS and the ferrite grain diameter.

As is shown by FIG. 2, by setting the ferrite grain diameter at about 8 μm or less and the ratio Ngb/Ng in the range from about 100 to 10,000, ΔTS became about 60 MPa or more, and thus bake hardenability was significantly improved. In contrast, when the ratio Ngb/Ng was less than about 100, ΔTS was not substantially increased, for example, to about 60 MPa or more, regardless of the ferrite grain diameter.

Figure 3:
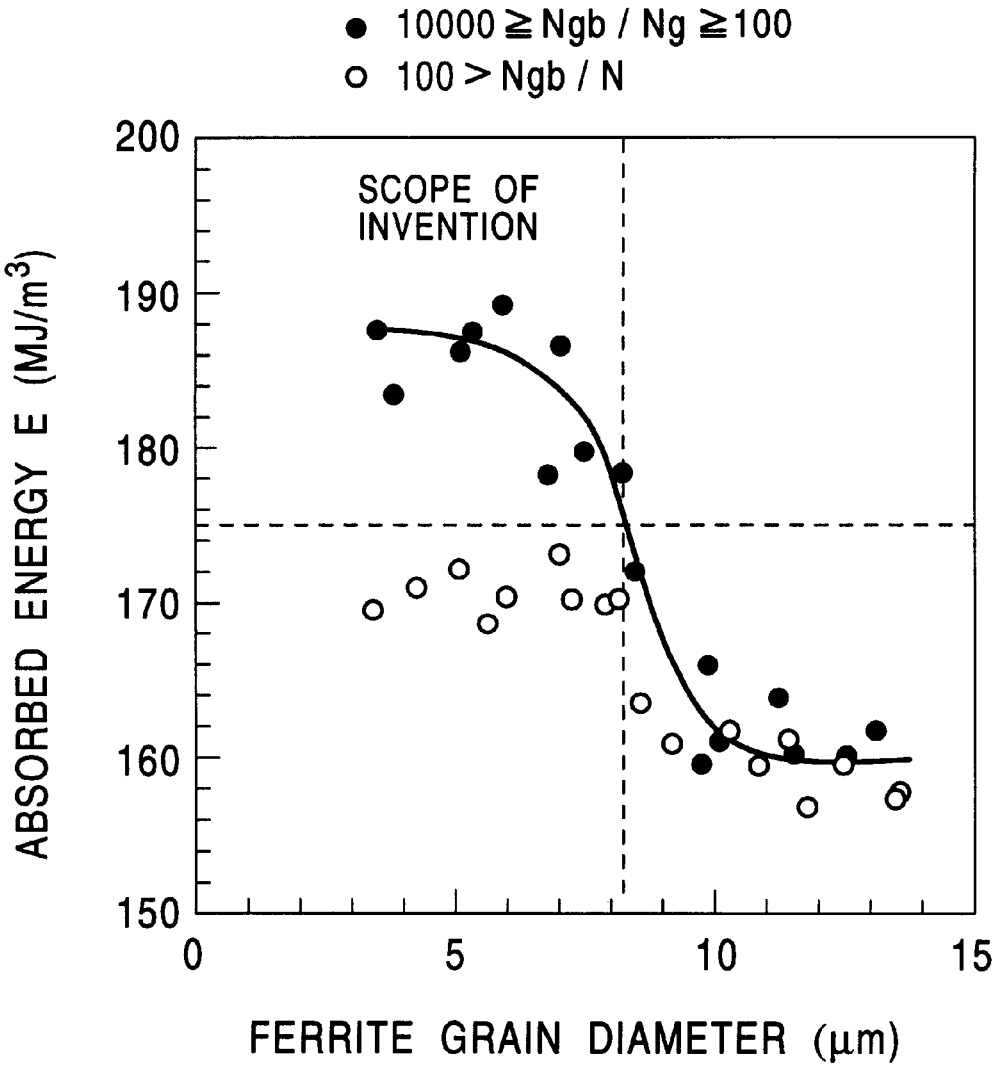
FIG. 3 is a graph showing a relationship between ferrite grain diameters and absorbed energy E in a tensile test at a high strain rate of $2\times10^3$/s after forming and paint baking.

With respect to the hot-rolled steel sheets, specimens for high-strain rate tensile test were collected. When a prestrain of tension of 5% was imposed and then removed, heat treatment at 170° C. for 20 minutes (corresponding to paint baking) was conducted. Next, a tensile test at a high strain rate of $2\times10^3$/s was performed, and tensile strength $TS_{HS}$ values and a stress-strain curve were obtained. Using the stress-strain curve, an integration value for strain of up to 30% was obtained, which was defined as absorbed energy E. FIG. 3 shows the relationship found between E and ferrite grain diameters.

As is shown by FIG. 3, by setting the ferrite grain diameter at about 8 μm or less and the ratio Ngb/Ng in the range from about 100 to 10,000, E became about 175 $MJ/m^3$ or more, and crash resistance was remarkably and significantly improved. In contrast, when the ratio Ngb/Ng was less than about 100, E was not substantially increased, for example, to about 175 $MJ/m^3$ or more, regardless of the ferrite grain diameter.

Figure 4:
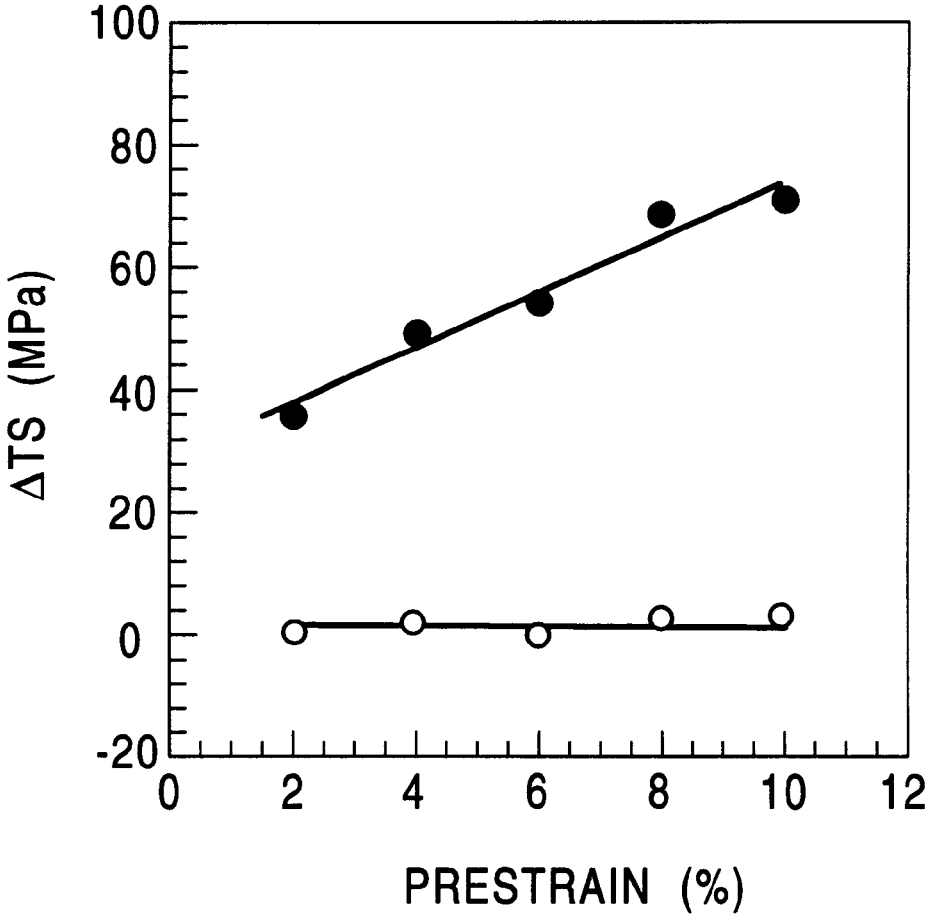
FIG. 4 is a graph which shows a relationship between prestrain in tension and ΔTS.

Furthermore, in experiment 3, among hot-rolled steel sheets used in experiment 2, a sheet having 67 ppm of solute N, a ferrite grain diameter of 6.2 μm, and a ratio Ngb/Ng of 126 and a sheet having 12 ppm of solute N, a ferrite grain diameter of 9.6 pm, and a ratio Ngb/Ng of 87 were selected, and an experiment similar to experiment 1 was conducted. The prestrain of tension was varied in a range from 2 to 10%. ΔTS, namely, the difference between the tensile strength $TS_{BH}$ after forming and paint baking and the tensile strength TS obtained by an ordinary tensile test for hot-rolled sheets, was obtained. FIG. 4 shows the obtained relationship between ΔTS and prestrain.

As is shown by FIG. 4, with respect to the sheet having 67 ppm of solute N, the ferrite grain diameter of 6.2 μm, and the ratio Ngb/Ng of 126, as the prestrain increases, ΔTS increases, and at any prestrain, a large ΔTS value is obtained. That is, when the prestrain is 5%, ΔTS is 50 MPa or more, and when the prestrain is 8%, ΔTS is 60 MPa or more.

In accordance with the present invention, a high tensile strength hot-rolled steel sheet having excellent bake hardenability, fatigue resistance, crash resistance, and resistance to room temperature aging contains about 0.01% to 0.12% by weight of C, about 2.0% by weight or less of Si, about 0.01% to 3.0% by weight of Mn, about 0.2% by weight or less of P, about 0.001% to 0.1% by weight of Al, about 0.003% to 0.02% by weight of N, and the balance Fe and incidental impurities. The hot-rolled steel sheet has a structure including a ferrite having an average grain diameter of about 8 μm or less, or preferably about 6 μm or less, as a primary phase, and further contains about 0.003% to 0.01% by weight, or preferably about 0.005% to 0.01% by weight of solute N. The ratio, Ngb/Ng, of an average concentration Ngb of N dissolved within a range of about ±5 nm from the ferrite grain boundary to an average concentration Ng of N dissolved in grains ranges from about 100 to 10,000. Preferably, the high tensile strength hot-rolled steel sheet further contains at least one of about 0.001% to 0.1% by weight of Ti and about 0.001% to 0.1% by weight of Nb. Preferably, the high tensile strength hot-rolled steel sheet also further contains at least one element selected from the group consisting of about 0.1% to 1.5% by weight of Ni, about 0.1% to 1.5% by weight of Cr, and about 0.1% to 1.5% by weight of Mo. In accordance with the present invention, preferably, the structure includes at least one structure selected from the group consisting of pearlite, bainite, martensite, and retained austenite as a secondary phase.

In accordance with the present invention, a plated layer may be formed on the surface of the high tensile strength hot-rolled steel sheet.

In accordance with the present invention, a method for producing a high tensile strength hot-rolled steel sheet having excellent bake hardenability, fatigue resistance, crash resistance, and resistance to room temperature aging includes the steps of heating a steel material containing about 0.01% to 0.12% by weight of C, about 2.0% by weight or less of Si, about 0.01% to 3.0% by weight of Mn, about 0.2% by weight or less of P, about 0.001% to 0.1% by weight of Al, and about 0.003% to 0.02% by weight of N in a temperature range from 1,000 to 1,300° C., and preferably from about 1,070 to 1,180° C.; rough-rolling the steel material; finish-rolling the rough-rolled steel material with a reduction at a final stand of about 10% or more at a finishing temperature FDT of ($Ar_3$+100° C.) to ($Ar_3$+10° C.); cooling at a cooling rate of about 50° C./s or more within 0.5 second after finish-rolling; and coiling at a coiling temperature of about 600 to 350° C. In the method for producing a high tensile strength hot-rolled steel sheet according to the present invention, the steel material preferably further contains at least one of about 0.001% to 0.1% by weight of Ti and about 0.001% to 0.1% by weight of Nb, and the steel material preferably further contains at least one element selected from the group consisting of about 0.1% to 1.5% by weight of Ni, about 0.1% to 1.5% by weight of Cr, and about 0.1% to 1.5% by weight of Mo.

The reasons for specifying the foregoing limits in compositions of hot-rolled steel sheets according to the present invention will be described. Hereinafter, % in the composition refers to % by weight.

C: about 0.01% to 0.12%

Carbon increases the strength of steels and the carbon content must be about 0.01% or more. If the carbon content exceeds about 0.12%, weldability is impaired. Therefore, the carbon content is specified within the limits of about 0.01% to 0.12% in the present invention.

Si: about 2.0% or less

Silicon increases the strength of steels by solid-solution strengthening, and the silicon content is adjusted depending on the desired strength. If the silicon content exceeds about 2.0%, workability is deteriorated.

Therefore, the silicon content is limited to about 2.0% or less in the present invention. Additionally, in order to secure strength, the silicon content is preferably set at about 0.003% or more.

Mn: about 0.01% to 3.0%

Manganese increases the strength of steels and also prevents hot shortness due to S. Active inclusion of this element is encouraged in the present invention. However, if the manganese content exceeds about 3.0%, workability is deteriorated. Therefore, the manganese content is limited to about 3.0% or less. In order to secure desired strength and prevent hot shortness, the manganese content must be about 0.01% or more.

P: about 0.2% or less

Phosphorus increases the strength of steels, and in order to secure desired strength, the phosphorus content is desirably set at about 0.005% or more. However, if the phosphorus content exceeds about 0.2%, weldability is deteriorated, and phosphorus may be segregated in the grain boundary, resulting in intergranular fracture. Therefore, the phosphorus content is limited to about 0.2% or less.

Al: about 0.001% to 0.1%

Aluminum acts as a deoxidizer, and the aluminum content must be about 0.001% or more in order to deoxidize steels. If the aluminum content exceeds about 0.1%, surface properties are deteriorated. Therefore, the aluminum content is specified within the limits of about 0.001% to 0.1%.

N: about 0.003% to 0.02%

Nitrogen is an important element in the present invention and is effective in increasing yield strength, in particular, tensile strength, after forming and paint baking by being dissolved in steel sheets. For that purpose, about 0.0030% or more of solute N must remain in steel sheets, and thus, the lower limit of the nitrogen content is set at about 0.0030%. Preferably, about 0.0050% of solute N remains in steel sheets. If the nitrogen content exceeds about 0.02%, formability is deteriorated. Therefore, the nitrogen content is specified within the limits of about 0.003% to 0.02%.

At least one of Ti: about 0.001% to 0.1% and Nb: about 0.001% to 0.1%

Both titanium and niobium form carbides, nitrides, and sulfides, and contribute to improving strength and toughness. Although the above effects are observed with the content of about 0.001% or more, if the content exceeds about 0.1%, amounts of C and N that contribute to bake hardenability decrease, thus unable to secure desired bake hardenability. Therefore, titanium and niobium are preferably limited in the range from about 0.001% to 0.1%.

At least one element selected from the group consisting of Ni: about 0.1% to 1.5%, Cr: about 0.1% to 1.5%, and Mo: about 0.1% to 1.5%

Nickel, chromium, and molybdenum are elements which increase strength of steels by solid-solution strengthening, and stabilize austenite (Y) so that the dual phase structure is easily formed. Such effects are recognized with the content of about 0.1% or more. If the content exceeds about 1.5%, formability, plating characteristics, spot weldability are deteriorated. Therefore, with respect to nickel, chromium, and molybdenum, the content is preferably set in the range from about 0.1% to 1.5%.

In hot-rolled steel sheets in accordance with the present invention, the balance, other than the ingredients described above, includes iron and incidental impurities. Sulfur and oxygen as incidental impurities form non-metallic inclusions, thus adversely affecting the quality. Therefore, the contents of sulfur and oxygen are preferably reduced to about 0.05% or less and about 0.01% or less, respectively.

The structure of hot-rolled steel sheets, in accordance with the present invention, having the composition described above includes a ferrite as a primary phase, and may include a secondary phase. In the present invention, in particular, in order to significantly enhance bake hardenability and improve fatigue resistance and crash resistance at the same time, the structure is refined, and furthermore, the amount of solute N and the state of solute N are properly adjusted.

In order to refine the structure, the ferrite as the primary phase has an average grain diameter of 8 $\mu$m or less. By refining grains, the grain boundary in which solute N exists is increased. If the average grain diameter of the ferrite exceeds about 8 $\mu$m, as shown in FIG. 2, a significant increase in tensile strength after forming and paint baking is not obtained, and bake hardenability is not greatly improved. Since there is no increase in tensile strength, improvements in fatigue resistance and crash resistance are not expected. Furthermore, by refining ferrite grains, the grain boundary area is increased, and by increasing the ratio of solute N in the grain boundary, deterioration in room temperature aging is suppressed. This is because of the fact that since solute N in the grain boundary is stabilized, it cannot be diffused at room temperature. If the average grain diameter of the ferrite exceeds about 8 $\mu$m, the effect is substantially reduced.

The second phase preferably includes at least one selected from the group consisting of pearlite, bainite, martensite, and retained austenite. By introducing the second phase, an increase in strength is enabled without adding large amounts of expensive additive elements, and fatigue resistance and crash resistance are improved. The content of the second phase is preferably set at about 3% to 30% by volume in view of workability.

In hot-rolled steel sheets of the present invention, about 0.0030% to 0.01% by weight of solute N remains. If the solute N content is less than about 0.0030% by weight, as shown in FIG. 1, an increase in tensile strength after forming and paint baking is decreased, and a significant improvement in bake hardenability is not obtained. Since there is no increase in tensile strength, significant improvements in fatigue resistance and crash resistance are not expected. On the other hand, if the solute N content exceeds about 0.01% by weight, room temperature aging significantly increases, the yield point is greatly increased, yield elongation is significantly increased, and total elongation is decreased, resulting in problems in practical use. Therefore, the amount of N dissolved in hot-rolled steel sheets is limited in the range from about 0.0030% to 0.01%, or preferably in the range from about 0.0050% to 0.01%. In the present invention, the amount of solute N refers to a value calculated by subtracting the amount of nitrides obtained by extraction separation from the amount of N in steels obtained by wet analysis.

Ngb/Ng: about 100 to 10,000

Ngb, a concentration of solute N in the ferrite grain boundary, and Ng, a concentration of solute N in ferrite grains, may be measured using a three-dimensional atom probe, an analytical electron microscope, or Auger electron spectroscopy. In the present invention, Ngb and Ng are obtained by detecting ionized atoms using the three-dimensional atom probe and by subsequent analysis. The measurement of concentrations of solute N may be started from in a grain through a grain boundary to an adjacent grain continuously, or from the surface of a grain boundary into a grain continuously. The measurement may be conducted one-dimensionally, two-dimensionally, or three-dimensionally. The concentration (Ng) of solute N in a stabilized section away from the grain boundary, and an average concentration of solute N within a range of about ±5 nm from the grain boundary are obtained. The measurement is conducted with respect to at least three grain boundaries, and average values are defined as Nb and Nbg, respectively.

If the ratio Ngb/Ng is less than about 100, an increase in tensile strength after forming and paint baking is decreased, and significant improvements in bake hardenability, fatigue resistance, and crash resistance are not obtained. On the other hand, if the ratio Ngb/Ng exceeds about 10,000, solute N in grain boundaries is precipitated, and thus an increase in tensile strength after forming and paint baking is decreased. Therefore, the ratio Ngb/Ng is limited in the range from about 100 to 10,000.

Although not clarified in detail at present, reasons for a significance increase in tensile strength after forming and paint baking with respect to hot-rolled steel sheets having the composition described above are believed to be as follows.

When steel sheets having mobile dislocations due to forming are subjected to heat treatment such as paint baking, because of interaction between mobile dislocations and solute N, solute N coheres in the vicinity of mobile dislocations, and the mobile dislocations are fixed, thus increasing yield stress. When the amount of solute N is further increased, in addition to the formation of Cottrell atmosphere, because of precipitation of fine nitrides, dislocations are fixed, and furthermore, nitrides and fixed dislocations obstruct the movement of mobile dislocations, thus increasing strength. Mobile dislocations occur in grain boundaries, and when grains are refined and grain boundaries are increased, even if forming is performed with the same strain, mobile dislocations are distributed at high density and homogeneously. Fixed dislocations obstructing mobile dislocations are also distributed at high density, and thus the movement of mobile dislocations becomes difficult, resulting in a significant increase in steel sheets. Furthermore, as the ratio Ngb/Ng is increased, that is, the amount of solute N in grain boundaries is increased, solute N is easily diffused in mobile dislocation groups deposited in the vicinity of grain boundaries, thus efficiently fixing mobile dislocations. On the other hand, solute N in grains only contributes to strengthening the ferrite material, and does not greatly contribute to an increase in tensile strength after forming and paint baking.

In steel sheets in which tensile strength after forming and paint baking is increased, even if deformation occurs at high strain rates, in a similar manner to that in deformation at low strain rates, fine nitrides and fixed dislocations obstruct the movement of dislocations, and the amount of absorbed energy required for deformation is increased, thus improving crash resistance. Additionally, when load is imposed repeatedly, since fixed dislocations and fine nitrides are distributed densely, fatigue resistance for resisting the development of fatigue crack is increased.

Next, a method for producing a steel sheet in accordance with the present invention will be described.

First, the steel material containing about 0.01% to 0.12% by weight of C, about 2.0% by weight or less of Si, about 0.01% to 3.0% by weight of Mn, about 0.2% by weight or less of P, about 0.001% to 0.1% by weight of Al, and about 0.003% to 0.02% by weight of N, and preferably further containing at least one of about 0.001% to 0.1% by weight of Ti and about 0.001% to 0.1% by weight of Nb and/or at least one element selected from the group consisting of about 0.1% to 1.5% by weight of Ni, about 0.1% to 1.5% by weight of Cr, and about 0.1% to 1.5% by weight of Mo, the balance being substantially Fe, is heated in a known apparatus such as a furnace. The steel material for rolling is preferably produced by casting and solidifying a liquid steel molten by a known method using known continuous casting or ingot making into a slab or the like.

In order to secure desired amounts of solute N in hot-rolled sheets, nitrides must be dissolved during heating, and in order to refine the structure of hot-rolled sheets, finer austenite grains are preferably produced during heating by lowering heating temperatures. Accordingly, the heating temperature is set in a range from about 1,000° C. to 1,300° C., and preferably from about 1,070° C. to 1,180° C. If the heating temperature is less than about 1,000° C., precipitation of N advances, and it becomes difficult to make solute N remain in hot-rolled sheets. If the heating temperature exceeds about 1,300° C., it becomes difficult to adjust the average ferrite grain diameter to 8 $\mu$m or less.

The heated steel material is then subjected to hot rolling.

The hot rolling comprises rough-rolling and finish-rolling. The steel material in which the thickness is adjusted appropriately by rough-rolling is subjected to finish-rolling.

The finish-rolling is performed with a reduction at a final stand of about 10% or more at a finishing temperature FDT of about ($Ar_3$+100° C.) to ($Ar_3$+10° C.).

If FDT exceeds about ($Ar_3$+100° C.), even if quenching is performed after hot rolling, the refinement of grains and the appropriate amount of solute N are not ensured. On the other hand, if FDT is less that about ($Ar_3$+10° C.), strain distribution in the thickness direction before transformation becomes inhomogeneous, and the average ferrite grain diameter cannot be refined to 8 $\mu$m or less. Therefore FDT is specified within temperature limits of about ($Ar_3$+100° C.) to about ($Ar_3$+10° C.).

If the reduction at the final stand is less than about 10%, strain accumulation before ferrite transformation is insufficient, and the refinement of grains and the control of solute N become insufficient. Therefore, the reduction at the final stand is set at about 10% or more. Preferably, the reduction at the final stand is set at 30% or less, and more preferably, at about 20% or less.

Within about 0.5 second after finish-rolling, cooling is performed at a cooling rate of about 50° C./s or more, and coiling is performed at a coiling temperature of about 600 to 350° C.

In the present invention, in order to increase the degree of supercooling while strain is accumulated, cooling is performed within about 0.5 second after finish-rolling at a cooling rate of about 50° C./s or more. Thus, more ferrite nuclei are generated, thus accelerating ferrite transformation, and solute N in y can be controlled so as not to be diffused into ferrite grains, thus increasing the amount of solute N in ferrite grain boundaries and increasing the ratio Ngb/Ng. If the time until the start of rapid cooling exceeds about 0.5 second, or the cooling rate is less than about 50° C./s, solute N is precipitated, and the desired amount of solute N cannot be secured, resulting in a decrease in bake hardenability, particularly, ΔTS. If the time until the start of rapid cooling exceeds about 0.5 second, or the cooling rate is less than about 50° C./s, nucleation of ferrite is delayed, and it becomes difficult to efficiently distribute N in grain boundaries.

If the coiling temperature exceeds about 600° C., solute N is precipitated after coiling, and it is not possible to adjust the amount of solute N required for bake hardening to a predetermined amount or more. On the other hand, if the coiling temperature is less than about 350° C., the sheet shape may deteriorate or there may be a difficulty in smoothly passing the sheet. Therefore, the coiling temperature is specified with the limits of about 600 to 350° C.

Hot-rolled steel sheets in accordance with the present invention are suitable for use as plating bases, and by forming various plated layers on surfaces, the hot-rolled steel sheets may be used as plated steel sheets. Types of plating include electrogalvanizing, hot-dip zinc coating, electrotinning, chromium electroplating, and nickel electroplating, all of which are suitable for plated layers formed on the surfaces of hot-rolled sheet in the present invention.

The following Examples disclose specific runs to illustrate particular embodiments selected. They are not intended to limit the scope of the invention, which is defined in the appended claims.

Specific Examples

Steels having compositions shown in Table 1 were made molten in a converter, and slabs were formed by continuous casting. After the slabs were heated at 1,080° C. and subjected to rough-rolling to obtain proper thicknesses, finish-rolling was performed under conditions shown in Table 2, rapid cooling was performed after rolling, and coiling was performed at coiling temperatures shown in Table 2. With respect to the above hot-rolled steel sheets, a structure examination, a tensile test, a bake hardenability test, a crash resistance test, a room temperature aging test, and a fatigue test were conducted.

(I) Structure Examination

With respect to sections perpendicular to the rolling direction in the hot-rolled steel sheets, using an optical microscope, structures of the hot-rolled steel sheets were identified. Using optical micrographs, the average ferrite grain diameters were also measured by quadrature which was a method for measuring grain diameters according to ASTM.

By chemical analysis, amounts of N and the amounts of N as AlN in the hot-rolled steel sheets were obtained. The amount of N dissolved in the hot-rolled steel sheet was defined as the amount of N in the hot-rolled steel sheet minus the amount of N as AlN.

Ngb and Ng were measured using a three-dimensional atom probe, and average values in at least three ferrite grains and grain boundaries were employed.

(ii) Tensile Test

Test specimens as per JIS No. 13B were collected from the hot-rolled sheets, and the tensile test was conducted at a strain rate of $10^{-3}$/s to obtain yield point YS, tensile strength TS, and elongation El.

(iii) Bake Hardenability Test

Test specimens as per JIS No. 13B were collected from the hot-rolled sheets. A prestrain in tension of 5% was imposed and then removed, heat treatment at 170° C. for 20 minutes (corresponding to paint baking) was conducted, and a tensile strength test was conducted again to obtain tensile strength $TS_{BH}$. A difference between the tensile strength $TS_{BH}$ after heat treatment corresponding to paint baking and the tensile strength TS as hot-rolled, namely, $\Delta TS = TS_{BH} - TS$, was obtained, and ΔTS was defined as an increase in tensile strength by forming and paint baking.

(iv) Crash resistance Test

Specimens for a high-strain rate tensile test were collected from the hot-rolled steel sheets. After a prestrain in tension of 5% was imposed and then removed, heat treatment at 170° C. for 20 minutes (corresponding to paint baking) was conducted. Next, a tensile test at a high strain rate of $2\times10^3$/s was performed, and tensile strength $TS_{HS}$ and a stress-strain curve were obtained. Using the stress-strain curve, an integration value for strain of up to 30% was obtained, which was defined as absorbed energy E. The size of the specimen for the high-strain rate tensile test and the testing method were according to Journal of the Society of Materials Science Japan, Vol. 47, No.10, p.1058–1058 (1998).

(v) Fatigue Test

Specimens for a fatigue test were collected from the hot-rolled steel sheets. After a prestrain in tension of 5% was imposed and then removed, heat treatment at 170° C. for 20 minutes (corresponding to paint baking) was conducted. Next, a tensile fatigue test according to JIS Z 2273 was conducted, and a fatigue limit ($1\times10^7$ times) $\sigma_{WBH}$ was obtained from an S-N diagram. An improvement in fatigue resistance was defined as $\Delta\sigma_w = \sigma_{wBH} - {}_w$, namely, a difference between the fatigue limit $\sigma_{wBH}$ and a fatigue limit $\sigma_w$ for steel sheets as hot-rolled, obtained by a fatigue test similar to the above.

(vi) Room Temperature Aging Test

Specimens were collected from the hot-rolled steel sheets. After aging treatment was performed at 50° C. for 400 hours, specimens for a tensile test according to JIS No. 13B were collected, and a tensile test was conducted to measure elongation $El_A$. Resistance to room temperature aging was evaluated based on $\Delta EL = El - El_A$, namely, a difference between the elongation $El_A$ and elongation El of steel sheets as hot-rolled.

The test results are shown in Table 3.

As is obvious from Table 3, examples of the present invention exhibit high bake hardenability, that is, ΔTS with 5% of prestrain is 40 MPa or more, ΔTS being a difference between tensile strength after forming and paint baking and tensile strength of the steel sheet as hot-rolled. Significantly improved fatigue resistance is also exhibited, that is, $\Delta\sigma_w$ is 110 MPa or more, $\Delta\sigma_w$ being a difference between the fatigue limit of the steel sheet after paint baking and the fatigue limit of the steel sheet as hot-rolled. Excellent crash resistance is also exhibited, that is, absorbed energy E absorbed during deformation at high strain rates is 160 $MJ/m^3$ or more. Furthermore a decrease in elongation due to room temperature aging is not substantially increased at 0.6% to 1.2%, and a decrease in resistance to room temperature aging is small. In contrast, comparative examples out of the scope of the present invention have ΔTS of 9 MPa or less and $\sigma\Delta_w$ of 65 MPa or less, exhibiting low improvements in bake hardenability and fatigue resistance. With respect to Steel No. 1–6, since the amount of solute N is excessively large and out of the scope of the present invention, resistance to room temperature aging is deteriorated.

In accordance with the present invention, hot-rolled steel sheets having excellent bake hardenability, fatigue resistance, crash resistance, and resistance to room temperature aging, which are suitable for use in interior materials for automobiles, can be produced stably, which is greatly advantageous to industrial applications.

TABLE 1

| Steel | Chemical Composition (% by weight) | | | | | | | | | | $Ar_3$ |
|---|---|---|---|---|---|---|---|---|---|---|---|
| No. | C | Si | Mn | P | S | Al | N | Ti | Nb | Others | ° C. |
| A | 0.04 | 0.07 | 0.90 | 0.040 | 0.005 | 0.040 | 0.0040 | | | | 872 |
| B | 0.08 | 0.10 | 1.25 | 0.018 | 0.002 | 0.030 | 0.0060 | | | | 824 |
| C | 0.07 | 0.12 | 1.20 | 0.015 | 0.003 | 0.030 | 0.0120 | | | | 827 |
| D | 0.12 | 0.02 | 1.40 | 0.015 | 0.003 | 0.040 | 0.0090 | 0.034 | | | 808 |
| E | 0.06 | 0.03 | 1.20 | 0.020 | 0.002 | 0.040 | 0.0110 | 0.044 | 0.023 | | 853 |
| F | 0.05 | 0.40 | 1.70 | 0.011 | 0.001 | 0.030 | 0.0060 | | | Cr:0.50, Mo:0.10 Ni:0.10 | 829 |
| G | 0.11 | 0.20 | 1.85 | 0.012 | 0.002 | 0.040 | 0.0140 | 0.10 | 0.04 | | 857 |
| H | 0.06 | 0.20 | 1.75 | 0.020 | 0.002 | 0.040 | 0.0230 | | | | 834 |
| I | 0.08 | 0.40 | 1.00 | 0.018 | 0.003 | 0.030 | 0.0012 | | | | 848 |
| J | 0.08 | 0.10 | 2.50 | 0.010 | 0.003 | 0.030 | 0.0100 | | | | 818 |

TABLE 2

| | | Slab | Hot Rolling | | Cooling Conditions | | |
|---|---|---|---|---|---|---|---|
| Steel Sheet No. | Steel No. | Heating Temperature ° C. | Finishing Temperature FDT ° C. | Reduction at Final Stand % | Coolin g Start Time Sec. | Cooling Rate ° C./s | Coiling Temperature ° C. |
| 1-1 | A | 1,080 | 910 | 15 | 0.3 | 58 | 560 |
| 1-2 | | | 910 | 15 | 0.16 | 53 | 660 |
| 1-3 | B | 1,080 | 850 | 15 | 0.25 | 53 | 570 |
| 1-4 | | | 850 | 15 | 0.32 | 29 | 570 |
| 1-5 | C | 1,080 | 850 | 15 | 0.25 | 52 | 600 |
| 1-6 | | | 850 | 15 | 0.25 | 55 | 340 |
| 1-7 | D | 1,080 | 820 | 15 | 0.19 | 54 | 540 |
| 1-8 | | | 820 | 5 | 0.21 | 51 | 590 |
| 1-9 | E | 1,080 | 880 | 15 | 0.33 | 59 | 580 |
| 1-10 | | | 880 | 15 | 2.22 | 52 | 580 |
| 1-11 | F | 1,080 | 850 | 15 | 0.28 | 112 | 450 |
| 1-12 | | | 940 | 15 | 0.38 | 70 | 450 |
| 1-13 | G | 1,080 | 880 | 15 | 0.28 | 58 | 590 |
| 1-14 | | | 820 | 15 | 0.24 | 53 | 590 |
| 1-15 | H | 1,080 | 850 | 15 | 0.21 | 121 | 450 |
| 1-16 | I | 1,080 | 880 | 15 | 0.19 | 58 | 620 |
| 1-17 | J | 1,080 | 880 | 15 | 0.21 | 62 | 550 |
| 1-18 | | | 880 | 15 | 0.27 | 14 | 600 |

TABLE 3

| Steel Sheet No. | Steel No. | Steel Sheet Structure: Structure | Steel Sheet Structure: Ferrite average grain diameter μm | Steel Sheet Structure: Solute N wt % | Steel Sheet Structure: Ngb/Ng | Tensile Characteristics: As Hot-rolled: Yield Point YS MPa | Tensile Characteristics: As Hot-rolled: Tensile Strength TS MPa | Tensile Characteristics: As Hot-rolled: Elongation EI % | Tensile Characteristics: After Paint Baking: Yield Point $YS_{BH}$ MPa | Tensile Characteristics: After Paint Baking: Tensile Strength $TS_{BH}$ MPa | Tensile Characteristics: After Paint Baking: ΔTS * MPa | Fatigue $\Delta\sigma_u$ ** MPa | Shock Resistance: Tensile strength at strain rate of 2000/s MPa | Shock Resistance: Absorbed Energy E *** $MJ/m^3$ | Room Temp. Aging Decrease in elongation after room temp. aging ΔE1 **** % | Remarks (PI: Example in present invention) CE: Comparative example) |
|---|---|---|---|---|---|---|---|---|---|---|---|---|---|---|---|---|
| 1-1 | A | F | 7.5 | 0.0036 | 138 | 270 | 371 | 34.8 | 413 | 423 | 52 | 113 | 612 | 161 | 1.2 | PI |
| 1-2 | | F | 7.9 | 0.0015 | 110 | 262 | 365 | 35.6 | 360 | 366 | 1 | 65 | 567 | 148 | 1.0 | CE |
| 1-3 | B | F + P | 7.2 | 0.0053 | 120 | 352 | 472 | 31.2 | 494 | 525 | 53 | 112 | 667 | 175 | 1.2 | PI |
| 1-4 | | F + P | 7.8 | 0.0035 | 62 | 344 | 467 | 32.3 | 439 | 468 | 25 | 84 | 623 | 166 | 0.8 | CE |
| 1-5 | C | F + P | 7.1 | 0.0081 | 118 | 373 | 489 | 29.6 | 516 | 551 | 62 | 114 | 682 | 183 | 1.2 | PI |
| 1-6 | | F + P | 6.9 | 0.0113 | 71 | 373 | 489 | 30.5 | 532 | 577 | 88 | 126 | 658 | 192 | 3.2 | CE |
| 1-7 | D | F + B | 7.6 | 0.0044 | 106 | 432 | 563 | 24.4 | 577 | 612 | 51 | 115 | 745 | 189 | 1.1 | PI |
| 1-8 | | F + B | 9.5 | 0.0031 | 58 | 420 | 551 | 25.2 | 522 | 558 | 7 | 63 | 695 | 177 | 2.5 | CE |
| 1-9 | E | F | 6.1 | 0.0038 | 145 | 535 | 617 | 21.8 | 669 | 670 | 53 | 117 | 798 | 207 | 0.9 | PI |
| 1-10 | | F | 9.3 | 0.0019 | 88 | 517 | 609 | 22.6 | 607 | 611 | 2 | 61 | 754 | 189 | 2.3 | CE |
| 1-11 | F | F + M | 3.8 | 0.0053 | 202 | 367 | 623 | 27.9 | 503 | 675 | 52 | 112 | 805 | 215 | 0.6 | PI |
| 1-12 | | F + M | 9.7 | 0.0038 | 64 | 403 | 618 | 26.1 | 506 | 627 | 9 | 62 | 762 | 196 | 2.4 | CE |

F: Ferrite
M: Martensite
P: Pearlite
B: Bainite
* $\Delta TS = TS_{BH} - TS$
** $\Delta\sigma_w = \sigma_{wBH} - \sigma_w$
*** Absorbed Energy E: deformed at strain rate of 2,000/s, strain up to 30%
**** $\Delta EL = E1 - E1_A$

TABLE 4

| Steel Sheet No. | Steel No. | Steel Sheet Structure: Structure | Steel Sheet Structure: Ferrite average grain diameter μm | Steel Sheet Structure: Solute N wt % | Steel Sheet Structure: Ngb/Ng | Tensile Characteristics: As Hot-rolled: Yield Point YS MPa | Tensile Characteristics: As Hot-rolled: Tensile Strength TS MPa | Tensile Characteristics: As Hot-rolled: Elongation EI % | Tensile Characteristics: After Paint Baking: Yield Point $YS_{BH}$ MPa | Tensile Characteristics: After Paint Baking: Tensile Strength $TS_{BH}$ MPa | Tensile Characteristics: After Paint Baking: ΔTS * MPa | Fatigue Δσ ** MPa | Crash resistance: Tensile strength at strain rate of 2000/s MPa | Crash resistance: Absorbed Energy E *** $MJ/m^3$ | Room Temp Aging Decrease in elongation after room temp. aging ΔE1 **** % | Remarks (PI: Example in present invention CE: Comparative example) |
|---|---|---|---|---|---|---|---|---|---|---|---|---|---|---|---|---|
| 1-13 | G | F + P | 6.4 | 0.0046 | 128 | 722 | 802 | 19.2 | 855 | 857 | 55 | 117 | 970 | 252 | 1.1 | PI |
| 1-14 | | F + P | 7.8 | 0.0021 | 77 | 718 | 800 | 18.3 | 786 | 802 | 2 | 46 | 931 | 241 | 0.8 | CE |
| 1-15 | H | F + M | 4.2 | 0.0186 | 113 | 378 | 609 | 28.7 | 493 | 692 | 83 | 119 | 818 | 217 | 4.5 | CE |
| 1-16 | I | F + P | 7.5 | 0.0004 | 102 | 354 | 445 | 32.2 | 370 | 446 | 1 | 37 | 619 | 162 | 0.4 | CE |

TABLE 4-continued

| Steel Sheet No. | Steel No. | Structure | Steel Sheet Structure: Ferrite average grain diameter μm | Solute N wt % | Ngb/Ng | Tensile Characteristics: As Hot-rolled: Yield Point YS MPa | Tensile Strength TS MPa | Elongation EI % | After Paint Baking: Yield Point $YS_{BH}$ MPa | Tensile Strength $TS_{BH}$ MPa | ΔTS * MPa | Fatigue Δσ ** MPa | Crash resistance: Tensile strength at strain rate of 2000/s MPa | Absorbed Energy E *** $MJ/m^3$ | Room Temp Aging Decrease in elongation after room temp. aging ΔE1 **** % | Remarks (PI: Example in present invention CE: Comparative example) |
|---|---|---|---|---|---|---|---|---|---|---|---|---|---|---|---|---|
| 1-17 | J | F + M | 5.2 | 0.0081 | 139 | 385 | 635 | 27.0 | 492 | 701 | 66 | 120 | 820 | 236 | 0.8 | PI |
| 1-18 | | F + B | 8.5 | 0.0043 | 68 | 441 | 582 | 28.7 | 475 | 610 | 28 | 71 | 748 | 192 | 2.0 | CE |

F: Ferrite
M: Martensite
P: Pearlite
B: Bainite
* $\Delta TS = TS_{BH} - TS$
** $\Delta\sigma_w = \sigma_{wBH - ow}$
*** Absorbed Energy E: deformed at strain rate of 2,000/s, strain up to 30%
**** $\Delta EL = E1 - E1_A$

What is claimed is:

1. A hot-rolled steel sheet having excellent bake hardenability, fatigue resistance, crash resistance, and resistance to room temperature aging comprising about:

0.01% to 0.12% by weight of carbon;

2.0% by weight or less of silicon;

0.01% to 3.0% by weight of manganese;

0.2% by weight or less of phosphorus;

0.001% to 0.1% by weight of aluminum;

0.003% to 0.02% by weight of nitrogen; and the balance being iron and incidental impurities, wherein the hot-rolled steel sheet has a structure comprising a ferrite having an average grain diameter of about 8 μm or less as a primary phase, the amount of solute N ranges from about 0.003% to 0.01% by weight, and the ratio, Ngb/Ng, of an average concentration Ngb of nitrogen dissolved within a range of about ±5 nm from the ferrite grain boundary to an average concentration Ng of nitrogen dissolved in ferrite grains ranges from about 100 to 10,000.

2. A hot-rolled steel sheet according to claim 1, further comprising at least one of about 0.001% to 0.1% by weight of titanium and about 0.001% to 0.1% by weight of niobium and/or at least one element selected from the group consisting of about 0.1% to 1.5% by weight of nickel, about 0.1% to 1.5% by weight of chromium, and about 0.1% to 1.5% of molybdenum.

3. A hot-rolled steel sheet according to either one of claims 1 and 2, wherein the ferrite average grain diameter is about 6 μm or less and the amount of solute Nitrogen ranges from about 0.005% to 0.01% by weight.

4. A hot-rolled steel sheet according to either one of claims 1 and 2, wherein the structure comprises at least one selected from the group consisting of pearlite, bainite, martensite, and retained austenite as a secondary phase.

5. A hot-rolled steel sheet according to either one of claims 1 and 2, wherein a plated layer is formed on the surface of the hot-rolled steel sheet.

* * * * *